US005924705A

United States Patent [19]

Kubelka

[11] Patent Number: 5,924,705

[45] Date of Patent: Jul. 20, 1999

[54] SINGLE-TRACK ROLLER SKATE AND WHEELS FOR USE THEREWITH

[75] Inventor: Axel Kubelka, Obdach, Austria

[73] Assignee: MRK Handels-AG, Zurich, Switzerland

[21] Appl. No.: 09/063,245

[22] Filed: Apr. 20, 1998

Related U.S. Application Data

[63] Continuation of application No. PCT/AT96/00211, Oct. 31, 1996.

[30] Foreign Application Priority Data

| | | | |
|---|---|---|---|
| Nov. 3, 1995 | [AT] | Austria | 1821/95 |
| Nov. 3, 1995 | [AT] | Austria | 1822/95 |
| Nov. 3, 1995 | [AT] | Austria | 1823/95 |

[51] Int. Cl.[6] ..... A63C 17/14

[52] U.S. Cl. ..... 280/11.22; 280/11.19; 301/5.3

[58] Field of Search ..... 280/11.27, 11.22, 280/11.23, 11.19; 301/5.3

[56] References Cited

U.S. PATENT DOCUMENTS

| | | | |
|---|---|---|---|
| 1,687,113 | 10/1928 | Stockdale | 301/5.3 |
| 5,401,037 | 3/1995 | O'Donnell et al. | 280/11.22 |
| 5,527,100 | 6/1996 | O'Donnell et al. | 301/5.3 |
| 5,725,284 | 3/1998 | Boyer | 301/5.3 |

*Primary Examiner*—Richard M. Camby
*Attorney, Agent, or Firm*—Thomas R. Vigil

[57] ABSTRACT

Single-track roller skate comprising at least three wheels which are disposed one behind the other and the rolling faces of which comprise in the cross-section substantially identical curvatures, wherein at least one front and/or rear wheel comprises at least in portions a comparatively different degree of elasticity than at least one central wheel. The rolling faces of the wheels comprise preferably a flat or slightly curved central portion and on both sides of this central portion in each case a more greatly curved running shoulder portion, wherein each running shoulder portion of the front and/or rear wheel comprises a comparatively higher degree of elasticity than that of the central wheel. In a convenient manner the tire body, forming the rolling face, of a front and/or rear wheel can be manufactured from a material having a lower Shore hardness than the wheel body of a central wheel.

15 Claims, 5 Drawing Sheets

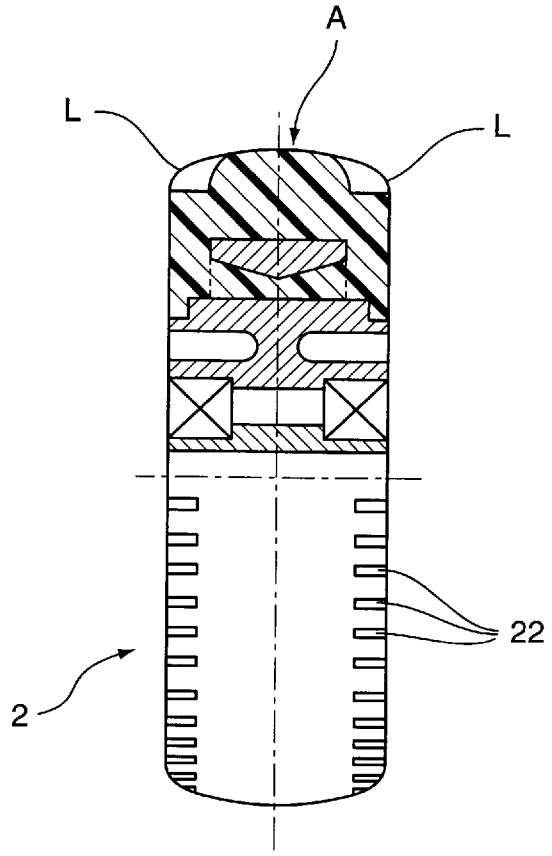
FIG. 6
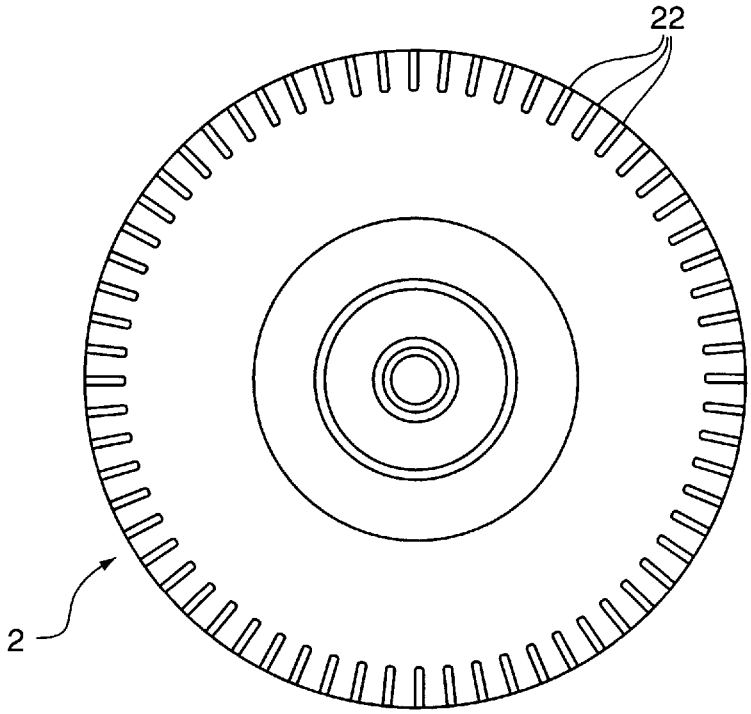

SINGLE-TRACK ROLLER SKATE AND WHEELS FOR USE THEREWITH

CROSS-REFERENCE TO RELATED APPLICATIONS

This is a continuing application of International Application PCT/AT96/00211, with an international filing date of Oct. 31, 1996.

BACKGROUND OF THE INVENTION

1. Field of the Invention

The present invention relates to a single-track roller skate comprising at least three wheels which are disposed one behind the other, the rolling faces of which comprise in the cross-section substantially identical curvatures and are designed symmetrically with respect to the longitudinal central plane, wherein the wheels with respect to a planar contact surface contact said contact surface both in a vertical and also inclined position. The present invention likewise relates to a set of wheels (set) and to a front or rear wheel and to a central wheel for use in such a roller skate.

2. Description of the Prior Art

Wheels for single-track roller skates which are commercially available are constructed from a single piece rim body for the purpose of receiving a ball bearing for the axle pin and from a tire body which is attached to the rim body and which is manufactured in one piece from a synthetic material (See for example U.S. Pat. No. 5,048,848).

Technical literature does, however, also describe wheels comprising a different construction which mainly comprise a combination of a harder material with a softer material. For example, DE 628 872-C describes two wheels, the wheel bodies of which comprise a softer outer and a harder inner rubber ring. GB 1 585 942 describes such a wheel for use on a dual-track roller skate or a skate board. DE 1 578 776-B illustrates a wheel for a dual track roller skate wherein an annular recess is provided on the lateral outer surface of the tire body. U.S. Pat. No. 4,699,432 describes a wheel, wherein a hard tire body is provided along its rolling face with a plurality of recesses which are filled with a relative soft material in order to be able to absorb better any irregularities in the ground surface. DE 228 679-C describes a metal running ring, consisting of a plurality of layers of differing hardness, for ball bearings or roller bearings. DE 908 232-C describes a wheel, wherein an inner hub ring and an outer running ring, which are manufactured from a metal, are mutually connected in a radial manner by way of an elastic interpositioned ring, in order to be able to transmit the pressure in a uniform manner. Moreover, DE 2 250 880-A describes a wheel, wherein a metal ring is cast as one into the wheel body consisting of a synthetic material and said metal ring forms a rolling face when protruding radially over the synthetic material body, in order to be able to use the roller on flat surfaces, e.g. on ice. Wheels for roller skates comprising a profiled running face are described inter alia in DE 1 031 192-C and DE 1 199 172-C, wherein in the former the profile is filled with a soft material. EP 652 035-A1 describes a roller skate, the wheels of which are composed of three discs, wherein the central disc is manufactured from a material having a low coefficient of friction (hard) and the lateral discs disposed on both sides of the central disc are manufactured from a material having a high coefficient of friction (soft). As a consequence, the lateral discs are used for the purpose of braking the roller skate.

Furthermore, it is generally already known to offer wheels for roller skates in sets of four or eight identical wheels, wherein the different sets comprise a different degree of (Shore-A) hardness. For example, in the brochure "Krypto Feeling" (available from the ISPO 1982) wheels for dual-track roller skates having a Shore hardness 78 A, 88 A, 92 A and 96 A are offered in order to adapt the roller skate to different applications, e.g. road, sports hall or disco. FR 2 606 654 describes a Shore hardness range from 35 to 100 for wheels.

Fundamentally, however, in the case of all above mentioned known roller skates (mainly four) identical wheels are used.

In order to steer single-track steerable roller skates, fundamentally three different steering methods are known, of which two are commercially available.

In the case of the most frequently used system, at least two non-identical widely protruding wheels can be mounted in a wheel sequence within a U-shaped frame, whereby the so-called "rockering effect" is created. (See for example the above mentioned U.S. Pat. No. 5,048,848 and FR 2 606 654). Although these roller skates can be easily steered, they do, however, suffer from a so-called rockering effect which renders the device unsafe for beginners and travel in a straight line becomes unsteady and unstable, so that according to the recommendation of the experts said roller skates should only be used in this arrangement by experienced skaters.

The other type of steering consists of a kinematic wheel suspension, which in the case of an inclination together with the loading by the skater controls [the wheels] in the direction of the inclination. The disadvantage of this arrangement is the relative weight dependency of the steering torque release, which should be fixed by means of a precise adjustment. Experience shows that owing to the time involved such an adjustment is, however, omitted. If this steering system also only reacts in association with the direction, considerably greater safety standards are demonstrated, as all wheels remain in constant contact with the ground and this steering system can therefore also be used readily for beginners.

The little known type of steering system which is unavailable commercially relates to a roller skate comprising three wheels, of which the central and front or rear wheel have different wheel cross-sections. This steering system has not become popular, since owing to the three wheel arrangement it is less stable and therefore intended more for practised skaters. This particularly applies within the inclined position in curves, which in any case require more skill. A steering system of this type is described inter alia in U.S. Pat. No. 2,570,349 (Kardhordo). This system was moreover operational at a time when roller skate wheel technology by no means allowed the travel comfort available nowadays and therefore skating was limited to special places and sports halls.

A roller skate of an improved design in contrast thereto is known from WO 95/30461 (MRK Handels-AG). This single-track roller skate comprises at least three wheels disposed one behind the other, the rolling faces of which are disposed in a symmetrical manner with respect to the longitudinal central plane and comprise in the cross-section substantially identical curvatures. In the case of one embodiment the wheel body comprises a higher degree of elasticity by virtue of forming a groove in the region of the transitional edges, so that when tilted towards the side the rolling face is deformed with respect to the wheel axis by means of the weight of the roller skater in the sense of a greater curvature and a good base contact is also achieved in this case.

SUMMARY OF THE INVENTION

The object of the present invention is to provide in comparison to the above mentioned known systems a safer and less expensive system in order to appeal to an even greater circle of users, even beginners. In particular, it should be possible to allow all wheels to be in constant contact with the ground and in fact not only during travel in a straight line but also in the inclined position, whereby the travel safety is considerably increased.

This object is achieved in the case of a single-track roller skate having identical rolling faces by the fact that at least one front and/or one rear wheel comprises at least in portions a comparatively different degree of elasticity than that of the at least one central wheel, preferably in a running shoulder portion of these wheels, which running shoulder portion is disposed at a spaced disposition from the longitudinal central plane. By virtue of the different degree of elasticity of the wheels it can be ensured that the roller skate is constantly in contact with the ground, on the other hand, however, the behaviour in curves is considerably improved by virtue of the purposeful and controlled deformation. Moreover, the similar design of the rolling faces of all wheels produces a particularly convenient and inexpensive manufacturing process of the steering system.

In the case of an embodiment of a roller skate in accordance with the invention which promises to be particularly successful in practice, the rolling face of the wheels comprises in a manner known per se a flat or slightly curved running shoulder portion, wherein each running shoulder portion of the front and/or rear wheel comprises a comparatively greater degree of elasticity than that of the central wheel. In the case of this embodiment, it is possible by virtue of the small contact surface of the running shoulder in the inclined position of the roller skate to achieve a relatively high contact pressure and thus a quite noticeable steering effect.

An additional advantage lies in the steer-turn effect—not associated with the incline—thus in the more favourable push-off behaviour with respect to non-steerable and kinematically steerable systems, because the non inclination- or load-dependent system allows a steering manoeuvre even in the counter direction (as on ice) and thus automatically optimizes the push-off angle. Furthermore, for this reason the undesired heavy wear on the front wheel also reduces, because for the push-off procedure the following wheels remain somewhat longer in contact with the ground and the procedure is performed in a more controlled manner.

In the case of a preferred embodiment of a roller skate in accordance with the invention, the tire body, forming the rolling face, of a front and/or rear wheel is made from a material which has a lower Shore hardness than the wheel body of a central wheel, wherein the Shore-A hardness amounts in a manner known per se to between 76 and 86 and the Shore-A hardness of a front and/or a rear wheel preferably amounts to between 76 and 82 and the Shore-A hardness of a central wheel preferably amounts to between 82 and 86. In this hardness region the steering effect is the most effective in practice for a roller skater of average skills.

The different degree of hardness of the tire body can, however, also be created in a convenient manner by virtue of at least partially coating the surface of the tire body of a front and/or rear and/or a central wheel or by virtue of layers of differing hardness in the tire body of a front and/or a rear wheel in comparison to a central wheel. These wheel body structures known per se can be used advantageously within the scope of the present invention in order to manufacture inexpensive wheel sets which comprise improved steering capabilities. In the case of the known possibilities, it should be noted that the cost aspect with respect to the standard models also played a role, on the other hand also the simplicity when being recommended to amateur users, in particular in the case of the standard replacement sets.

Therefore, all wheels can be manufactured in a standard production shape, it is only necessary to be able to vary the material within an assembly sequence or within the wheels themselves. In the case of only three wheels the hardest must be mounted inside, in the case of four wheels two softer wheels are mounted on the outside at the ends and two harder wheels are mounted in the central frame region, and in the case of more than four wheels the softer wheels must be mounted towards the front and rear in a graduated manner.

The prime object of the system is to use similar wheel or running face cross sections which allow ground contact from all positions yet on the other hand can be produced in a rational manner in a standard shape. The single difference to be evaluated is the elasticity, at least of the wheel running shoulders, for which a quasi rectangular cross section within a wheel assembly sequence is recommended. In so doing, the running shoulder radius should be greater than each of the wheel running shoulders, wherein the portion of intended application, degree of wear and amount of friction can be determined in advance; greater rolling face radius—greater running shoulder radii, approx. up to 25% of the wheel width; smaller rolling face radius—smaller running shoulder radii, approx. up to 10% of the wheel width. In order not to downgrade the steering effect as a result of too flat rolling face radii and the associated amount of friction there applies for a standard wheel width (24 mm) for the radius of curvature of a running shoulder 5% to 10% of same as the height dimension of the central portion.

The most convenient manner in which to convert the idea of the invention into practice resides in the fact that four wheels of identical shape are produced, wherein the tire body of in each case two wheels is injection moulded or cast from a different material, namely a harder or softer material.

An advantageous embodiment of the roller skate in accordance with the invention is produced inter alia by virtue of the fact that the tire body, forming the rolling face of a front and/or a rear wheel comprises on both sides of the longitudinal central plane lateral recesses which increase the elasticity of the tire body in the region of these recesses. These recesses can be either a circumferential groove disposed on both sides of the wheel in the tire body, which groove is adjacent to the running shoulder of the wheel, or radial recesses disposed in the region of the running shoulder, e.g. a blade profile. In the case of grooves these can be sealed by virtue of corresponding disc-shaped inserts which are tailored to suit the profile of the grooves.

For this reason, the wheels are designed with standardized production shapes, preferably with external structures which are associated with the specific use and are of a concentric or radial type, in particular on their lateral faces, which are immediately adjacent to the wheel running shoulders. Thus, despite generally identical running face cross sections a different elastic behaviour of the running shoulders is achieved, which can be varied by virtue of differing material characteristics, insertion or omission of the elements within the assembly sequence.

The lateral surfaces mentioned can in addition by means of the blades contribute to the reduction of the wear on the running shoulders, similar to that in the case of car tires.

Bores, slits and the like can have a similar effect; furthermore concentric grooves, indents and wave structures likewise allow the effect of elasticity which is particularly important in the case of the end wheels. A secondary aspect resides in an intentional necking of the wheel cross section immediately adjacent to the running shoulder region, which achieves an articulated adherence of the running faces to the running surface.

Furthermore, undercut grooves can in particular also serve to receive inserts, rings or discs, which among other things provide adjustability, be it as an addition or by means of a screw connection on the outer rim core and by designing as a conical plate spring.

An essential aspect for the cost calculation is that the manufacturing shapes require for example to be identical and only to be equipped with conversion inserts. With sales in mind it would be possible to identify the wheel by means of shims without the prospective purchaser having to have any special knowledge regarding the material hardness; classification according to the skater's weight is easier. Apart from this, it is only necessary to mount the more elastic wheels at the frame end or in the case of more than four wheels in a further graduated manner and the less elastic wheels towards the frame middle.

In a preferred embodiment of a roller skate in accordance with the invention it is provided that each wheel comprises in a manner known per se a rim body on which is attached the tire body forming the rolling face, wherein the rim body of a central wheel is designed differently in comparison to the rim body of a front and/or rear wheel such that the elasticity of the central wheel in comparison to that of a front and/or rear wheel is greater at least in the region of the running shoulder. This can for example be achieved in that the rim body of a central wheel protrudes in its central portion to a greater extent in the direction of the rolling face than the rim body of a front and/or rear wheel, or in that the rim body of a central wheel comprises on both sides of the longitudinal central plane an annular extension protruding in the direction of the rolling face. Further, the [sic] the ring extension can also be designed as an insert which can be removed from the rim body.

In the case of the known possibilities, it should be noted that the cost aspect with respect to the standard shapes also played a role, on the other hand also the simplicity when being commended to amateur users, in particular in the case of the standard replacement sets.

Therefore all wheels can be manufactured in a completely standard production shape as opposed to the wheel inner bodies, cages or rims which should be varied in their design at least in their shape, that the wheel shoulder support should be designed differently internally distanced, in a resilient manner, in a flexible manner, have something placed beneath it or be supported from below.

Otherwise when more than four wheels are provided the more elastic wheels must be mounted graduated towards the frame ends, the less elastic wheels in the case of three wheels, the less elastic in the central frame region.

Further support possibilities are available in the clamping arrangement by virtue of rim plates which are screwed to the wheel core and can even be adjusted regardless of whether in addition concentric form-locking elements such as grooves or neckings are provided within the wheel lateral wall.

Owing to the naturally heavy wear on the wheels of a roller skate, a plurality of replacement wheels are available on the roller skate market. It follows from this that an object of the invention was also to offer a relevant solution for this spare parts market. For this purpose for a roller skate which is the subject matter of the present invention a set of wheels (set) is provided which consists of at least a front and/or rear wheel and at least a central wheel and wherein at least a front and/or rear wheel (2) comprises at least in portions a comparatively different degree of elasticity than that of the at least one central wheel (1).

In the case of a commercially available roller skate comprising four rollers it has proven to be advantageous if the set comprises two identically designed front and rear wheels (2) and two identically designed central wheels (1). In this case the customer can purchase in a convenient manner two sets for his/her pair of roller skates in order to be able to replace all the wheels.

BRIEF DESCRIPTION OF THE DRAWINGS

Reference is made hereinunder to the attached figures showing further, non-limiting exemplified embodiments for wheels which can be used in a roller skate in accordance with the invention, wherein these figures show:

FIG. 4*b* shows a central wheel, FIG. 5*b* shows a central wheel, FIG. 6 shows a front and/or a rear wheel for a roller skate in accordance with the invention in a schematic cross-sectional view and a lateral view, FIGS. 9*a* and 9*b* show schematic cross-sectional views through wheels for a roller skate of the type in accordance with the invention wherein FIG. 9*a* shows a central wheel and FIG. 9*b* shows a front and/or a rear wheel, FIGS. 10*a* and 10*b* show schematic cross-sectional views through wheels for a further roller skate of the type in accordance with the invention, wherein FIG. 10*a* shows a central wheel and FIG. 10*b* shows a front and/or rear wheels and FIG. 11*a* and 11*b* show schematic cross-sectional views through a further embodiment.

DESCRIPTION OF THE PREFERRED EMBODIMENT(S)

Figure 1:
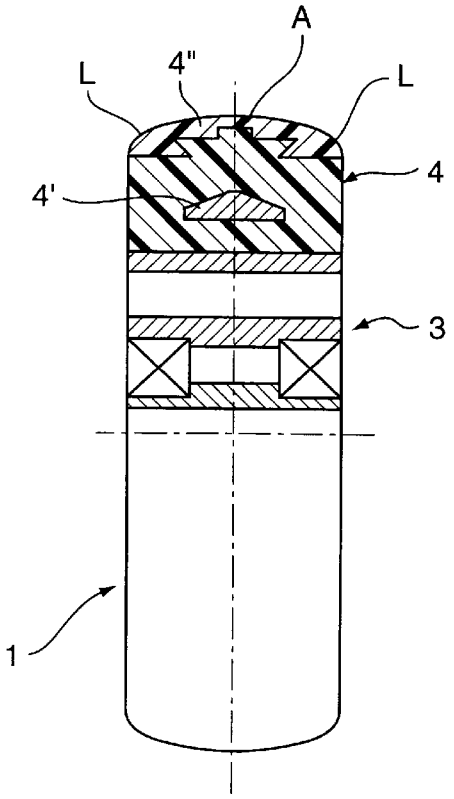
FIG. 1 a schematic cross-sectional view through a central wheel for a roller skate of the type in accordance with the invention.

Reference is first made to FIG. 1 in which a central wheel 1 for a roller skate of the type in accordance with the invention is illustrated. The roller skate as such is not illustrated here, since any roller skate in which at least three wheels can be mounted one behind the other is suitable for the implementation of the present invention. Conventionally, a frame is provided with four wheels, namely a front wheel, two central wheels and a rear wheel. This also applies especially to frame constructions which can be placed against the foot and all sports equipment which is placed against the foot and is operated with wheels disposed one behind the other.

The wheel 1 shown in FIG. 1 comprises a rim body 3 and concentric about this rim body 2 a tire body 4 which forms the rolling face and which is attached in a non-releasable manner generally to this rim body 3 by means of an injection moulding or casting process. Both the rim body 3 and also the tire body 4 are manufactured from a suitable synthetic material. The rim body 3 can be a commercially available standard rim body or also a special rim body which is already tailored to suit the requirements of the present invention. Likewise provided in FIG. 1 are the two-sided mountings for the wheel 1 on a bearing spigot, which is suitable for assembling on a frame of a roller skate.

The tire body 4 comprises a carrier portion 4' facing the rim body 3 and a surface portion 4" which faces the rolling face and which portion forms with its free surface the rolling face A. The curvature of the rolling face can be selected as desired within the scope of the present invention. However, in practice a rolling face A of the type illustrated in FIG. 1 is advantageous and comprises a flat or slightly curved central portion and comprises on both sides of this central portion in each case a portion L which is formed as a running shoulder. The surface portion 4" of the tire body 4 is fixedly connected to the carrier portion 4', e.g. the surface portion 4" can be injection moulded onto the carrier portion 4' or cast as one therewith or adhered thereto. It is likewise possible that the surface portion 4" is simply upturned over the carrier portion 4' and fixedly held thereon by means of internal stress, similar to that of a tire on a rim. In the latter case, the surface portion 4" can be replaced so that the base body of the wheel 1 can be used several times.

A wheel, whose surface portion is formed to be more elastic at least in the region of the running shoulder than that of the central wheel, is suitable in the most convenient manner as a front and/or rear wheel for use with the wheel illustrated in the FIG. 1. However, it is also possible to use as a front and/or rear wheel a conventional tire body manufactured from one material, e.g. the material of the carrier portion 4' of FIG. 1. The shape of the rolling face A is, however, substantially identical in the case of the front and/or rear wheel. Furthermore, the central wheel 1 shown in FIG. 1 can be combined with any other wheels whose rolling faces have the identical contour and comprise a greater elasticity at least in the region of the running shoulders. A higher elasticity can in certain circumstances also be created by means of appropriate recesses or different rim bodies.

Roller skates currently commercially available are normally equipped with four wheels. A roller skate in accordance with the invention is provided in this case with two central wheels of the type illustrated in FIG. 1 and in each case with a front and a rear wheel, the rolling face of which, in the region of the running shoulders, is more elastic. When the roller skater wishes to negotiate a curve, he/she must tilt the roller skate towards the side. As a consequence, owing to the comparatively greater elasticity of the front and rear wheel, the running shoulders of these wheels are deformed to a greater extent than the running shoulders of the central wheels. The contact points of all wheels are aligned along a curve and the roller skater can readily negotiate even tight curves using minimum energy and without having to lose any ground contact with a single wheel. This is particularly of great advantage for hockey players and artistic skaters. This invention provides the hobby skater in a more advantageous manner with greater security and a more comfortable travelling sensation even in critical situations, e.g. rapid curves.

Figure 2:
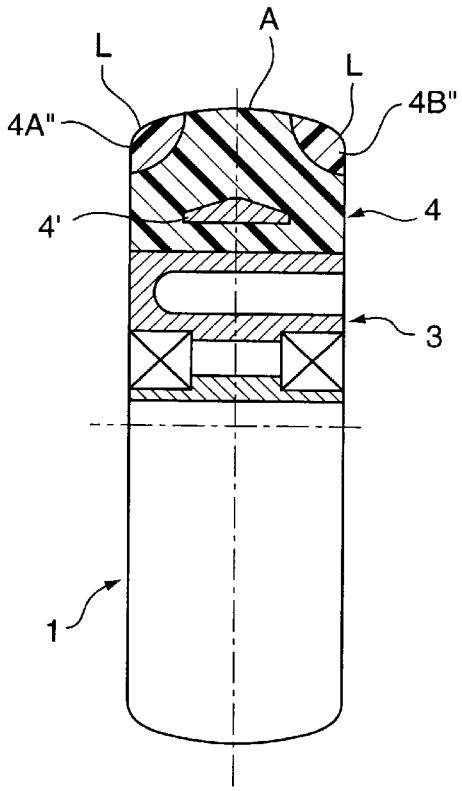
FIG. 2 shows a schematic cross-sectional view through a central wheel for a further roller skate of the type in accordance with the invention.

FIG. 2 illustrates a central wheel 1 which is constructed in a similar manner to that of FIG. 1 and for this reason like designations are used to describe this wheel. In place of a single surface coating, in the case of the wheel 1 as shown in FIG. 2, however, two comparatively slightly elastic surface portions 4*a*" and 4*b*" are provided, which are disposed in the region of the running shoulder L of the wheel 1. This division of the surface portion into two, results in an advantageous manner in a somewhat softer straight progression since the wheel 1 when travelling in a straight line lies with the central portion of the rolling face A on the carrier body 4' which is generally of a softer nature. It is feasible to provide a front or rear wheel of an identical design, wherein the surface portions 4*a*", 4*b*" are of a comparatively more elastic nature, so that the running shoulders maintain the desired greater elasticity. However, for the front and/or rear wheel it is also possible to use all other suitable wheels, the rolling faces of which are substantially curved in an identical manner and whose running shoulder portion is designed in a comparatively more elastic manner. The aforementioned also applies to the remaining design of the roller skate.

Figure 3:
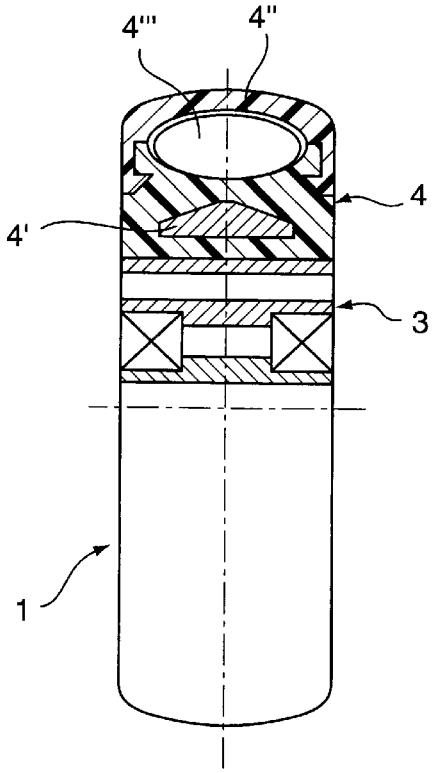
FIG. 3 shows a schematic cross-sectional view through a further central wheel.

FIG. 3 shows a further central wheel 1 which is likewise constructed in a similar manner to that of the wheel shown in FIG. 1, for which reason like designations are again used. In contrast to the earlier exemplified embodiments, in the case of the wheel 1 shown in FIG. 3 a circumferential tube 4"' is disposed between the carrier portion 4 and the surface port 4", similar to that of a bicycle tire. This tube 4"' can be filled with a liquid or with compressed air, in order to adjust the characteristics of the wheel to suit the respective requirements. This tube 4"' can, however, likewise be manufactured from a full rubber or another elastic material. The aforementioned also applies for the front and/or rear wheel.

Figure 4A:
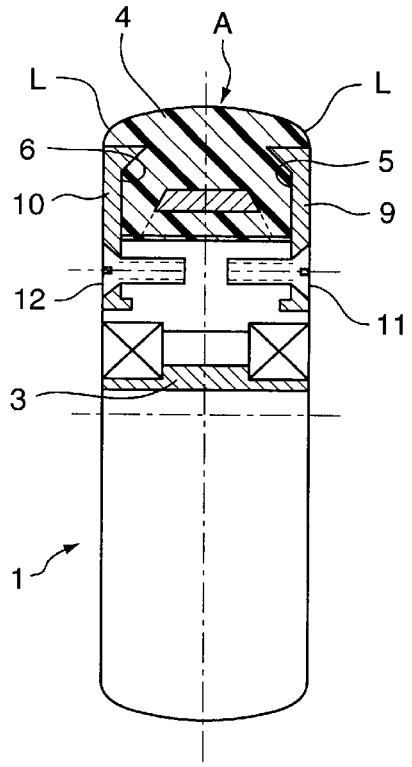
FIG. 4*a* and 4*b* show schematic cross-sectional views through wheels for a roller skate of the type in accordance with the invention, wherein 4*a* shows a front and/or rear wheel
Figure 4B:
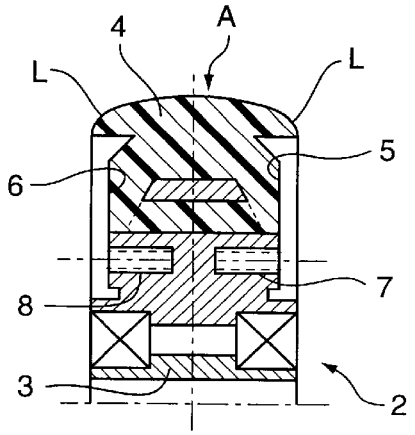

Reference is made hereinunder to FIGS. 4*a* and 4*b*, in which is illustrated in each case a central wheel 1 and a front or rear wheel 2 for a further exemplified embodiment of a roller skate of the type in accordance with the invention.

The wheels 1 and 2 of FIGS. 4*a* and 4*b* comprise in each case a rim body 3 and concentric around this rim body 3 in each case a tire body 4 which forms the rolling face and which is generally attached in a non-releasable manner to this rim body 3 by means of an injection moulding or casting process. The rim body 3 is a special rim body which is already tailored to suit the requirements of the present invention. Likewise evident in FIG. 4*a* are the mountings on both sides for the wheel 1 on a bearing spigot which is suitable for assembly on a frame of a roller skate. The rolling face A comprises a flat or slightly curved central portion and on both sides of this central portion in each case a portion formed as a running shoulder L. The slightly curved central portion renders it possible to travel in a straight line in a safe and steady manner, whereas the more extensively curved running shoulders produce higher pressure forces as the roller skate tilts to the side and these forces influence the steering behaviour in a positive manner.

Circumferential annular recesses 5, 6 are provided on both sides on the wheels 1 and 2 and extend radially both over a partial portion of the rim body 3 and over a partial portion of the tire body 4, wherein the outer boundaries of the recesses 5, 6 adjoin directly the running shoulders L of the rolling face A. The recesses 5, 6 comprise on their outer and inner boundaries in addition groove-shaped indentations.

On the rim body 3 in the region of the recesses 5, 6 are provided on both sides in each case a plurality of threaded bores 7, 8 which are aligned transverse to the running direction and are uniformly distributed over the periphery of the rim body. As is evident in FIG. 4*a,* these threaded bores 7, 8 serve to attach in each case an annular inflexible disc 9, 10, which completely fills out the allocated recess 5, 6. The discs 9, 10 are attached by way of a plurality of screws 11, 12 which are screwed with the threaded bores 7, 8.

By virtue of the discs 9, 10 in the recesses 5, 6, the wheel 1, which is used as a central wheel, is comparatively less elastic in the region of the running shoulders L of the rolling face A than the wheel 2, in which the recesses 5, 6 are not filled and which is intended for use as a front or rear wheel. This difference in the elasticity results in an improved behaviour when negotiating curves, since owing to the contact pressure in the region of the running shoulder L the front and rear wheel 2 can deform in an elastic manner as the roller skate tilts to the side, whereas the central wheel 1 owing to it being of a less elastic nature substantially does not change shape. This difference in the extent of the deformation allows the contact points of the different rollers 1, 2 to be aligned along a circle and the roller skater will travel along a curve without having to exert any particular force and whilst avoiding any wear, wherein all four rollers of the roller skate contact the contact face and thus a stable travelling sensation is created.

An advantage of the illustrated embodiment lies among other things in the fact that a front wheel can be moved into the central wheel position and vice versa with only a few manual operations. This results in a standard and therefore inexpensive manufacturing process.

Figure 5A:
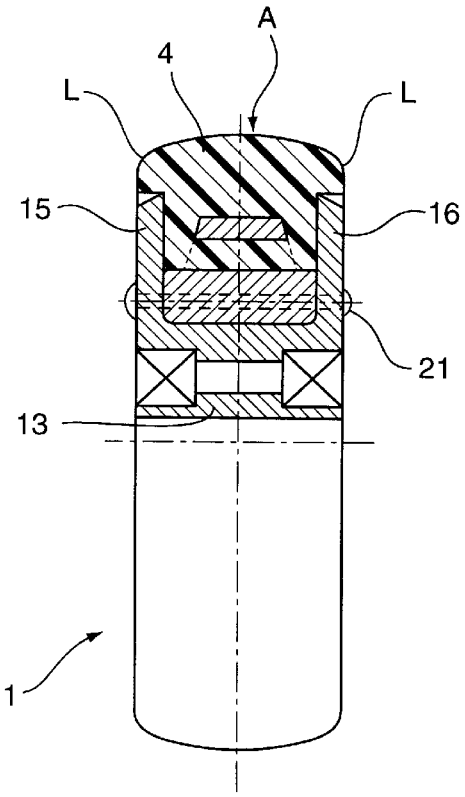
FIG. 5*a* and 5*b* show schematic cross-sectional views through wheels for a further roller skate of the type in accordance with the invention, wherein 5*a* shows a front and/or a rear wheel
Figure 5B:
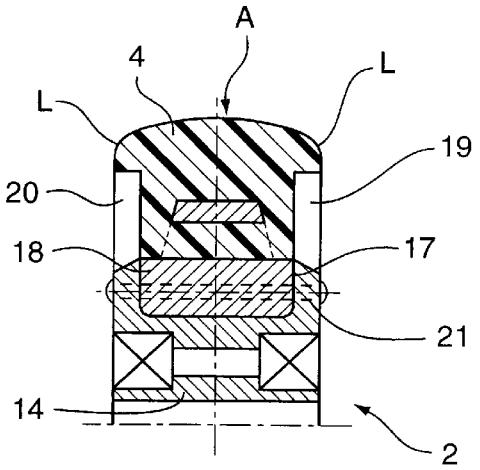

FIGS. 5*a* and 5*b* show a further exemplified embodiment for a central wheel 1 and a front and/or rear wheel 2. In place of the removable or attachable discs of the exemplified embodiment shown in FIGS. 4*a* and 4*b* in the case of the exemplified embodiment in accordance with FIGS. 5*a* and 5*b* different rim bodies 13 and 14 are provided for the central wheels 1 and the front and/or rear wheels 2, wherein the rim body 13 comprises two lateral annular extensions 15, 16 which protrude radially outwards in the direction of the rolling face as far as the running shoulder and in contrast the rim body 14 comprises two substantially shorter annular extensions 17, 18, so that in each case an annular recess 19, 20 is formed between the ends of the extensions 17, 18 and the running shoulders L of the rolling face A . This recess 19, 20 comprises a comparatively higher elasticity of the shoulder L of the wheel 2.

Since in the case of the exemplified embodiment illustrated in FIGS. 5*a,* 5*b,* each rim body 13, 14 is divided along the longitudinal central plane, the tire body 4 and the halves of the rim body 13, 14 are held together by means of rivets 21 which are guided through the extensions 17, 18 or 15, 16 and supported on their outer faces. This rim body 13, 14 renders it possible to change in a convenient manner the wear-sensitive tire bodies and thus to reuse all other parts of the wheel.

FIG. 6 illustrates a schematic lateral view of an exemplified embodiment for a front or rear wheel 2 of a roller skate in accordance with the invention and a semi-view from the front or a half-section.

In contrast to the earlier exemplified embodiments, in the case of the wheel 2 illustrated in FIG. 6 the elasticity of the running shoulder L of the running face A is increased by means of recesses 22 which are aligned in a radial and transverse manner with respect to the running direction. The recesses 22 disposed only in the region of the running shoulder L form so-called blades in a similar manner to a car tire.

In combination with the front or rear wheel 2 of FIG. 6, it is feasible to use any central wheel, the elasticity of which is less in the running shoulder region. For example, this is an identically constructed wheel but does not comprise any blades. It can, however, also be a wheel comprising blades which is manufactured from a harder material.

Figure 7:
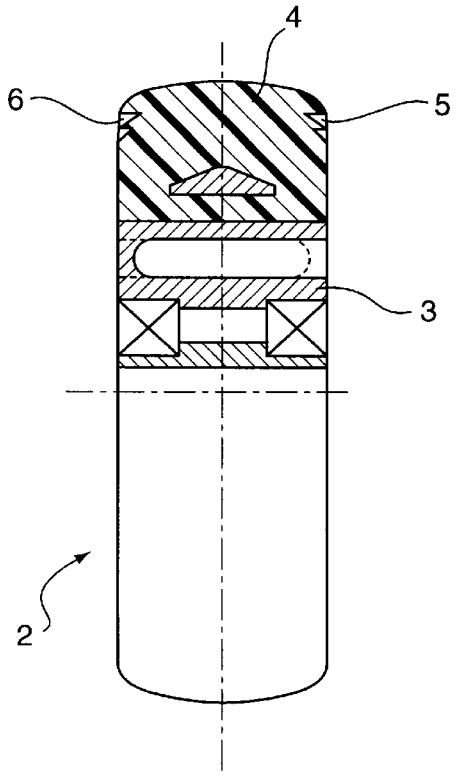
FIG. 7 and 8 show further exemplified embodiments for front and/or rear wheels of a roller skate in accordance with the invention.
Figure 8:
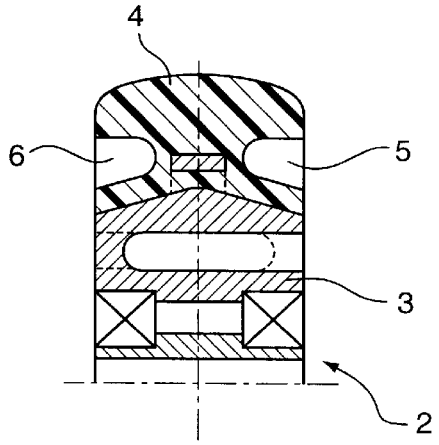

FIGS. 7 and 8 illustrate further exemplified embodiments for front or rear wheels 2 of a roller skate in accordance with the invention which comprise on the lateral faces of the tire bodies 4 circumferential grooves 5, 6 which comprise according to their intended application slightly different geometric shapes. In addition, in the case of the exemplified embodiment of these figures, the rim body 3 is somewhat differently designed in order to influence the elasticity of the rolling face in a desired manner.

These front and/or rear wheels 2 can be combined again with each central running wheel, whose running face is curved in a substantially identical manner and which comprises less elasticity in the region of the running shoulders.

Figure 9A:
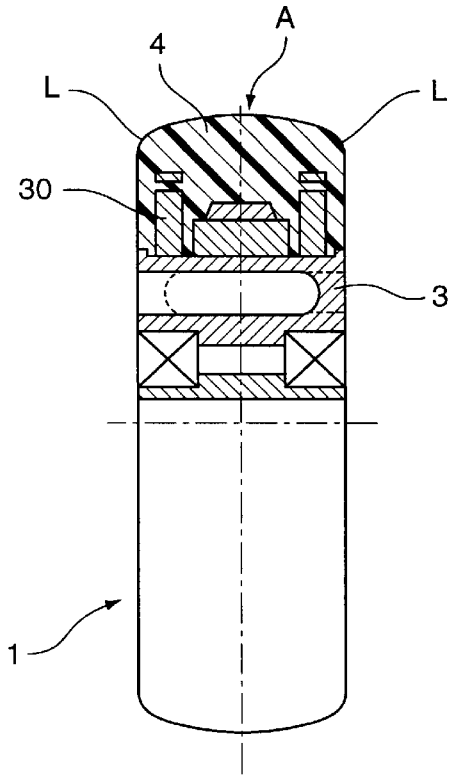
Figure 9B:
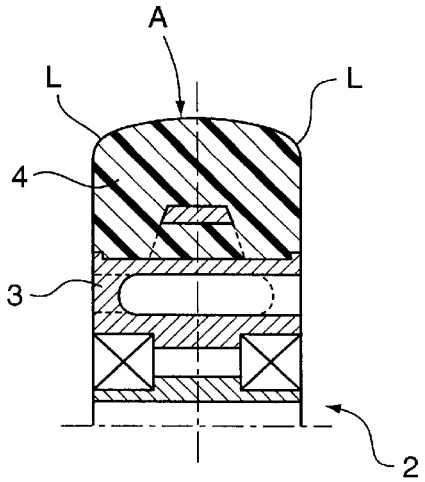

A central wheel 1 and a front and/or rear wheel 2 for a further exemplified embodiment of a roller skate in accordance with the invention are illustrated in FIGS. 9*a* and 9*b*.

The wheel 1 shown in FIG. 9*a* comprises a rim body 3 and concentric about this rim body 3 a tire body 4 which forms the rolling face and which is generally attached to this rim body 3 in a non-releasable manner by means of an injection moulding or casting process.

The particular design of the rim body 3 of the wheel 1 is illustrated in FIG. 9*a* by the fact that it comprises on both sides of the longitudinal central plane annular extensions 29, 30 which protrude outwards in the direction of the rolling face A. These annular extensions 29, 30 result in the rolling face A being less elastic at its more extensively curved running shoulder portions L in comparison to a wheel without such extension. A substantially identically constructed wheel 2 is illustrated in FIG. 9*b* without such extensions.

As already mentioned, the different degrees of elasticity of the wheels 1 and 2 in the region of their running shoulders L results in an improved behaviour when negotiating curves, since, as the roller skate tilts to the side owing to contact pressure in the region of the running shoulder L the front and the rear wheel 2 can deform in an elastic manner, whereas the central wheel 1 owing to it comprising a lesser degree of elasticity remains substantially un-deformed. These different degrees of deformation render it possible to align the contact points of the different rollers 1, 2 along a circle.

Figure 10A:
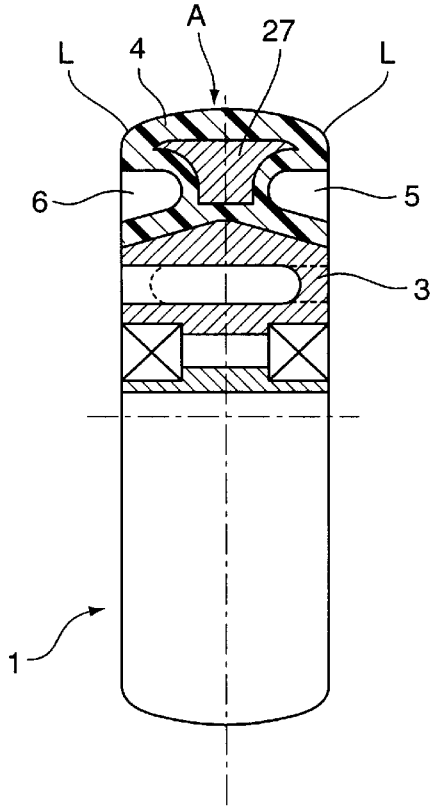
Figure 10B:
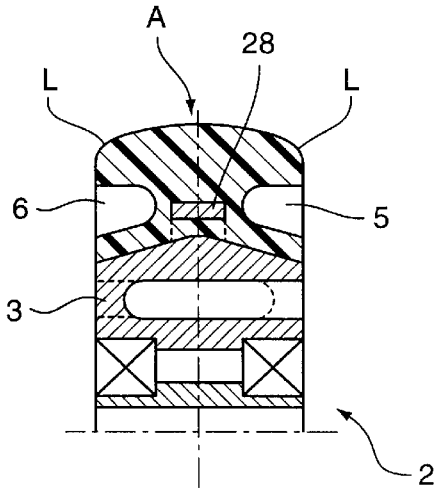

A further exemplified embodiment for central wheels 1 and front and/or rear wheels 2 of a roller skate in accordance with the invention is illustrated in FIGS. 10*a* and 10*b*. As is evident in FIG. 10, the rim body 3 comprises a mushroom-shaped, outwardly directed annular extension 27 which extends as far as directly in front of the rolling face A of the tire body 4 and almost over the entire width of this tire body 4. The extension 27 thus renders it possible for the elasticity to remain constant over the entire region of the rolling face A.

In contrast thereto, the rim body 3 of the wheel 2 shown in FIG. 10*b* comprises an extension 28 which extends only slightly in the direction of the rolling face A and serves only to attach and stabilise the tire body 4 on the rim body 3.

Furthermore, in the case of wheels 1 and 2 circumferential grooves 5, 6 are provided on both sides of the tire body 4, which grooves change the elasticity of these wheels in the region of the running shoulders L, namely substantially increase the elasticity in the case of the roller 2 and produce a slight change in the elasticity in the case of the roller 1.

The different degrees of elasticity of the rollers 1, 2 in their running shoulder regions again renders possible the aforementioned improved behaviour when negotiating curves of a roller skate in accordance with the invention.

Figure 11A:
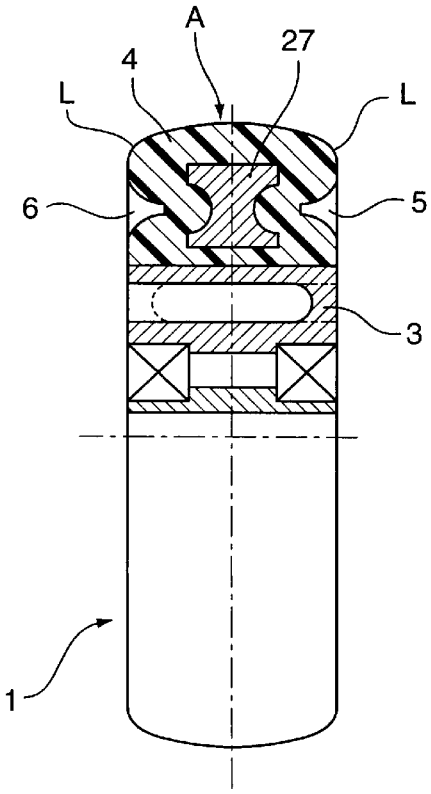
Figure 11B:
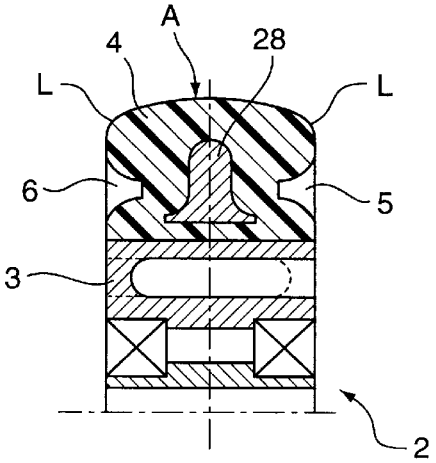

FIGS. 11*a* and 11*b* illustrate further exemplified embodiments for a central wheel 1 and a front and/or rear wheel 2. The tire bodies 4 of these wheels comprise on both sides in each case a circumferential groove 5, 6, similar to that of the exemplified embodiment shown in FIG. 10. The different degree of elasticity of these wheels 1, 2 in the region of their running shoulders L is again produced by virtue of the different design of the rim body 3 which comprises in the case of wheel 1 an extension 27 which widens at its outer end, whereas the extension 28 in the case of the wheel 2 is rounded in a tapering manner on its front end.

Although the invention is described in connection with the exemplified embodiments illustrated as having four wheels, it is by no means limited thereto. The invention can also be implemented with three wheels or with more than four wheels. Furthermore, it is to be noted that a front and a rear wheel need not necessarily be provided. It is also possible that only a front or only a rear wheel of the type in accordance with the invention is used in combination with at least one central wheel and, where appropriate, with other conventional wheels. Likewise, in addition so-called neutral wheels can be provided, the elasticity of which lies in the running shoulder region between that of the central and that of the front or rear wheel.

For the purposes of the present invention it is desirable if the rolling faces of all wheels comprise the identical curvature. Slight differences can, however, be readily tolerated or under certain circumstances even desired. If the radius of curvature of the front wheel is smaller in comparison to the central wheel, then an additional steering effect is produced by removing or reducing the contact pressure. A slight difference in curvature is therefore to be regarded as "substantially identically curved" within the scope of the present invention.

In addition, the possibility exists to combine the steering effect essential to the invention with a "rockering-steering effect", in that the central wheels are slightly lower or the front and/or rear wheel are/is slightly raised. However, the addition of these further steering effects has little effect as far as the safety is concerned.

As a predetermined contact pressure is required for the purpose of steering the roller skate in the case of identical rolling faces, which contact pressure deforms the running shoulders of the front and/or the rear wheels, it can be provided that predetermined embodiments are tailored to suit the weight of the skater in order to optimize the steering effect. For example, it is possible to provide for children light elastic tire bodies or tire bodies with greater relative differences in hardness and for heavier roller skaters to provide less elastic tire bodies in order to compensate for the greater weight.

Finally, it should be noted that the rolling face need in no way be a smooth surface as illustrated. The rolling face can also comprise a certain profiled structure, e.g. longitudinal grooves, transverse grooves, ribs or another suitable surface structure. Essential for the term "rolling face" within the scope of the present invention is the enveloping area of all these structures. Furthermore, it is naturally possible to combine all exemplified embodiments illustrated in the figures and described above and their equivalents according to their intended application to form a set of wheels for a roller skate of the type in accordance with the invention.

I claim:

1. A single-track roller skate, comprising at least three wheels (1,2) which are disposed one behind the other, each wheel having a rolling face (A) which is designed in a symmetrical manner with respect to the longitudinal central plane and comprises in cross-section, a substantially identical curvature, the wheels, with respect to a planar contact surface, make contact with this contact surface both in the vertical and also in the inclined position, characterized in that at least one wheel (1,2) comprises, at least in portions thereof, a comparatively different degree of elasticity than that of the at least one central wheel (1), and the rolling faces (A) of the wheels (1,2) comprise a flat or slightly curved central portion and on both sides of this central portion, a more greatly curved running shoulder portion (L), wherein each running shoulder portion (L) of the front and/or rear wheel (2) comprises a comparatively hither degree of elasticity than that of the central wheel (1).

2. The roller skate according to claim 1 characterized in that each wheel (1, 2) comprises a rim body (3) on which is attached a tire body (4) forming the rolling face (A), wherein the rim body (3) of the central wheel (2) in comparison to the rim body (3) of the front and/or rear wheel (1) is formed in a different manner, such that the elasticity of the central wheel (2) is increased in comparison to that of the front and/or rear wheel (1) at least in the region of the running shoulder (L).

3. The roller skate according to claim 1, characterized in that a tire body (4), forming the rolling face, of the front and/or rear wheel (2) is manufactured from a material having a lower Shore hardness than the wheel body (4) of the central wheel (1).

4. The roller skate according to claim 1, characterized in that the Shore-A hardness of the wheels (1,2) amounts to between 76 and 86, wherein the Shore-A hardness of the front and/or rear wheel(s) (2) amounts to between 76 and 82 and the Shore-A hardness of the central roller (1) amounts to between 82 and 86.

5. The roller skate according to claim 1, characterized in that the differing degree of elasticity is achieved by means of a surface coating (4", 4*a"*, 4*b"*), at least in portions on a tire body (4), wherein the surface coating (4", 4*a"*, 4*b"*) on a central wheel is performed with materials of a different hardness in comparison to a front and/or rear wheel.

6. The roller skate according to claim 1, characterized in that the differing degree of hardness is achieved by means of inserts (4") of differing hardness on a tire body, wherein the inserts of a front and/or rear wheel (2) comprise a different degree of hardness in comparison to a central wheel (1).

7. The roller skate according to claim 1 characterized in that a tire body (4), forming the rolling face, of a front and/or rear wheel (2) comprises on both sides of the longitudinal central planes lateral recesses (5, 6, 19, 20) which increase the elasticity of the tire body (4) in the region of these recesses (5, 6, 19, 20).

8. The roller skate according to claim 7, characterized in that the tire body (4) comprises on both sides of the longitudinal central plane one circumferential groove (5, 6, 19, 20) which is adjacent to the running shoulder (L) of the wheel.

9. The roller skate according to claim 8, characterized in that the grooves (5, 6, 19, 20) are sealed by means of corresponding disc-shaped inserts (9, 10, 15, 16) which are tailored to suite the profile of the grooves (5, 6, 19, 20).

10. The roller skate according to claim 7, characterized in that the tire body (4) comprises, in the region of the running shoulder (L), radial recesses (22).

11. The roller skate according to claim 2, characterized in that the rim body (3) of the central wheel (2) protrudes in its central portion in the direction of the rolling face (A) to a greater extent that the rim body (3) of the front and/or rear wheel (2).

12. The roller skate according to claim 2 characterized in that the rim body (3) of a central wheel (1) comprises, on both sides of the longitudinal plane, an annular extension (15, 16, 29, 30) protruding in the direction of the rolling face (A).

13. The roller skate according to claim 12, characterized in that the annular extension is formed as an insert (9, 10) which can be removed from the rim body (3).

14. For use in a roller skate, a plurality of wheels (Set) comprising at least three wheels (1, 2) which are disposed one behind the other and the rolling faces (A) of which are designed in a symmetrical manner with respect to the longitudinal central plane and comprise in the cross-section substantially identical curvatures, wherein the wheels with respect to a planar contact surface contact this contact surface both in the vertical and also in the inclined position, comprising at least one front and/or rear wheel (2) and at least one central wheel (1), wherein at least one front and/or rear wheel (2) comprises, at least in a portion thereof a comparatively different degree of elasticity than that of the at least one central wheel, and the rolling faces (A) of the wheels (1,2) comprise a flat or slightly curved central portion and on both sides of this central portion, a more greatly curved running shoulder portion (L), wherein each running shoulder portion (L) of the front and/or rear wheel (2) comprises a comparatively higher decree of elasticity than that of the central wheel (1).

15. The plurality of wheels according to claim 14, characterized in that said set of wheels comprise two identically designed front and rear wheels (2) and two identically designed central wheels (1).

* * * * *

UNITED STATES PATENT AND TRADEMARK OFFICE

CERTIFICATE OF CORRECTION

PATENT NO. : 5,924,705
DATED : July 20, 1999
INVENTOR(S) : Axel Kubelka

It is certified that error appears in the above-identified patent and that said Letters Patent is hereby corrected as shown below:

Column 12, line 20, "hither" should be --higher--;

Column 12, line 56, "planes" should be --plane--;

Column 12, line 67, "suite" should be --suit--;

Column 13, line 07, "that" should be --than--;

Column 14, line 14, "decree" should be --degree--.

Signed and Sealed this

Eighth Day of August, 2000

*Attest:*

*Attesting Officer*

Q. TODD DICKINSON

*Director of Patents and Trademarks*